United States Patent [19]

Lazzari

[11] Patent Number: 4,628,641

[45] Date of Patent: Dec. 16, 1986

[54] BELT SANDER WITH REDUCIBLE OVERALL DIMENSION FEATURES

[75] Inventor: Luigi Lazzari, Rimini, Italy

[73] Assignee: Mini Max s.r.l., Rimini, Italy

[21] Appl. No.: 719,099

[22] Filed: Apr. 2, 1985

[30] Foreign Application Priority Data

Apr. 6, 1984 [IT] Italy ..... 3417 A/84

[51] Int. Cl.[4] ..... B24B 21/00

[52] U.S. Cl. ..... 51/135 R; 51/142; 51/166 TS

[58] Field of Search ..... 51/135 R, 170 EB, 166 FB, 51/166 TS, 147, 142

[56] References Cited

U.S. PATENT DOCUMENTS

| | | | |
|---|---|---|---|
| 159,526 | 2/1875 | Otis | 51/166 FB |
| 1,457,064 | 5/1923 | Huff | 51/166 FB |
| 2,229,466 | 1/1941 | Mattison | 51/135 R |
| 2,752,734 | 7/1956 | McGibbon | 51/142 |
| 3,103,768 | 9/1963 | Tsunoda et al. | 51/142 |
| 4,269,096 | 5/1981 | Boone | 51/166 TS |

*Primary Examiner*—Frederick R. Schmidt
*Assistant Examiner*—Maurina Rachuba
*Attorney, Agent, or Firm*—Cushman, Darby & Cushman

[57] ABSTRACT

A belt sander for processing such materials as wood, plastics, and similar materials. The belt sander comprises a table for accommodating a workpiece thereon, and a sand belt holder beam which is slidably mounted on cross guides overlying the table. The table is pivotable along a longitudinal horizontal axis so as to assume horizontal and vertical attitudes. The beam guides are linked such that, with the sander in the inoperative condition, they can be set not to exceed the transverse overall dimension of the sander frame. Provision for pivotal mount of the table and the guides is effective to allow a significant reduction in the overall dimensions of the belt sander.

7 Claims, 7 Drawing Figures

BELT SANDER WITH REDUCIBLE OVERALL DIMENSION FEATURES

BACKGROUND OF THE INVENTION

This invention relates to a belt sander with reducible overall dimension features for processing wood, plastics, marble, metals, and the like.

It is a known fact that in the technical field of wood sanding with sand belts, sanders are employed which fall within two general classes: sanders with a wide sand belt, when the belt spans the full width of the workpiece, and sanders with a narrow sand belt, when the belt width is smaller than the workpiece's, thereby sanding must be performed in several passes. Sanders of the latter type usually comprise a table on which the workpiece is placed, and a beam, overlying the table, which carries the sand belt and a pad which holds the belt close against the workpiece from the back or reverse side of the belt.

Also available are sanders wherein the beam is held stationary and the table traversed below it, and sanders wherein the relative movement of the table and beam is reversed, i.e. it is the beam which is traversed above the table.

Such prior sanders all incur the serious disadvantage that their space requirements are substantial and, especially with small establishments, difficult to meet, also on account of the fact that sanders are seldom operated on a full time basis.

SUMMARY OF THE INVENTION

It is a primary object of this invention to provide a belt sander so structured that its overall dimensions may be reduced to a more compact volume when not in use.

It is another object of this invention to provide a belt sander which affords improved performance over similar conventional machines, especially relating to the practicability of particular sanding procedures and the handling of large size workpieces.

Such objects are achieved by a belt sander comprising a table whereon at least one workpiece would be positioned for the sanding thereof, and a sand belt and sand belt pad holder beam which is mounted slidably along cross guides overlying the table, and characterized in that the table is mounted pivotable about a longitudinal horizontal axis between a position of horizontal lay and a position of vertical lay, and that the beam guides are linked such that, with the sander in the inoperative condition, the beam guides may be set within the transverse outline of the sander frame.

BRIEF DESCRIPTION OF THE DRAWINGS

Further advantages and features will become apparent from the following detailed description of some preferred embodiments of the invention, as illustrated by way of example in the accompanying drawings, where.

DESCRIPTION OF THE PREFERRED EMBODIMENTS

Figure 1:
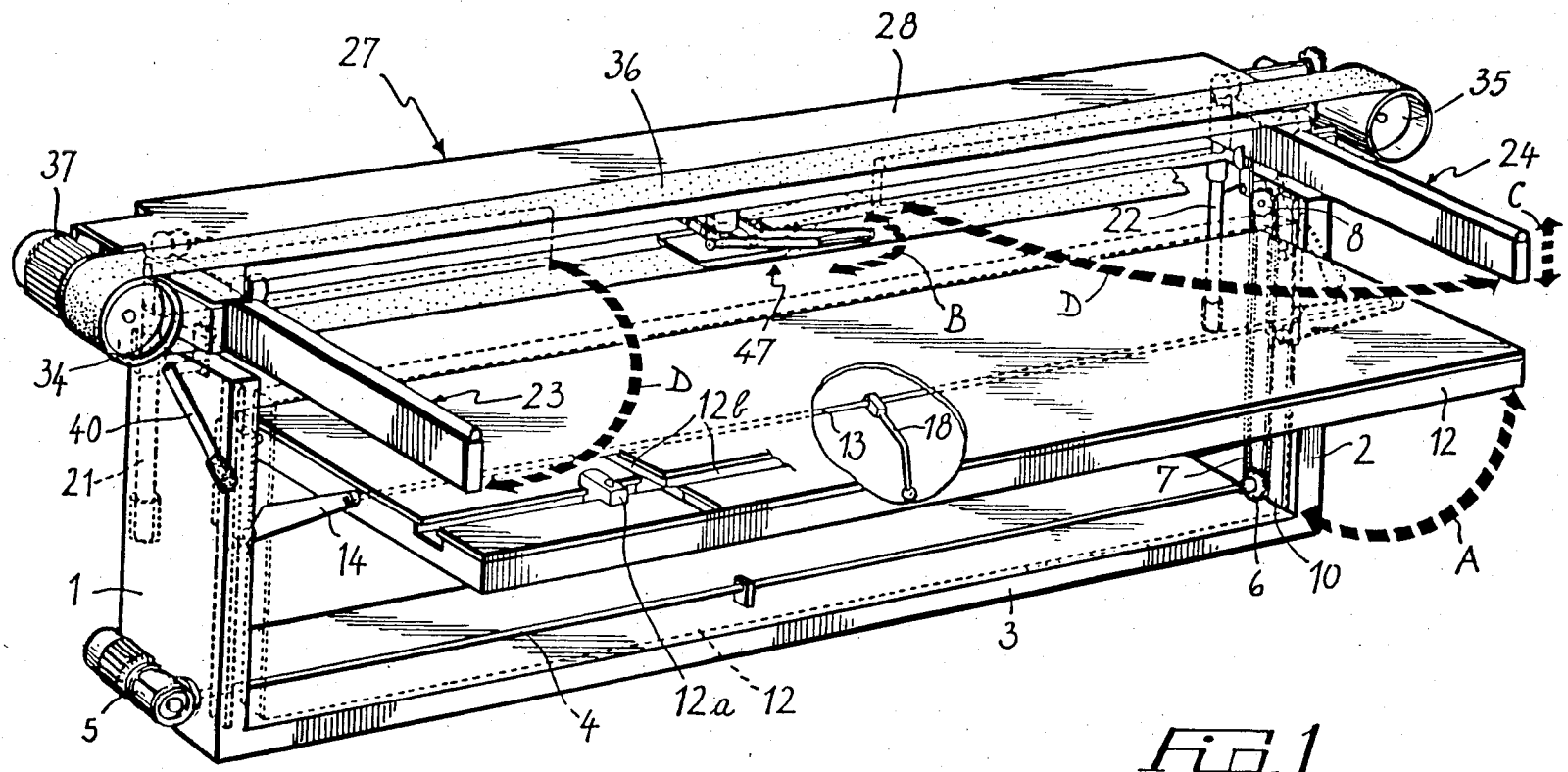
FIG. 1 is a perspective view, taken from the front, of a belt sander according to the invention.

Indicated at 1,2 in the drawings are two sidepieces of the belt sander frame which are interconnected by a base 3. Directly above the base 3, centrally and on the sidepieces 1,2, there is rotatably supported a shaft 4 driven from a gear motor 5 mounted to the outside of the sidepiece 1.

Keyed to the shaft 4, close to the inward faces of the sidepieces 1,2, are two sprocket wheels 6 (in the drawings, only the one adjacent the sidepiece 2 being shown) wherearound two respective chains 7 are trained with runs extending vertically upwards. The chains 7 form closed loops around sprocket idlers 8 mounted on the tops of the sidepieces 1,2 cantilever-fashion.

Attached to those runs of the chains 7 which confront the sander front side, and at the same level, are two respective shoes 9 which are guided in their vertical movement by guides 10 attached to the inward faces of the sidepieces.

Figure 3:
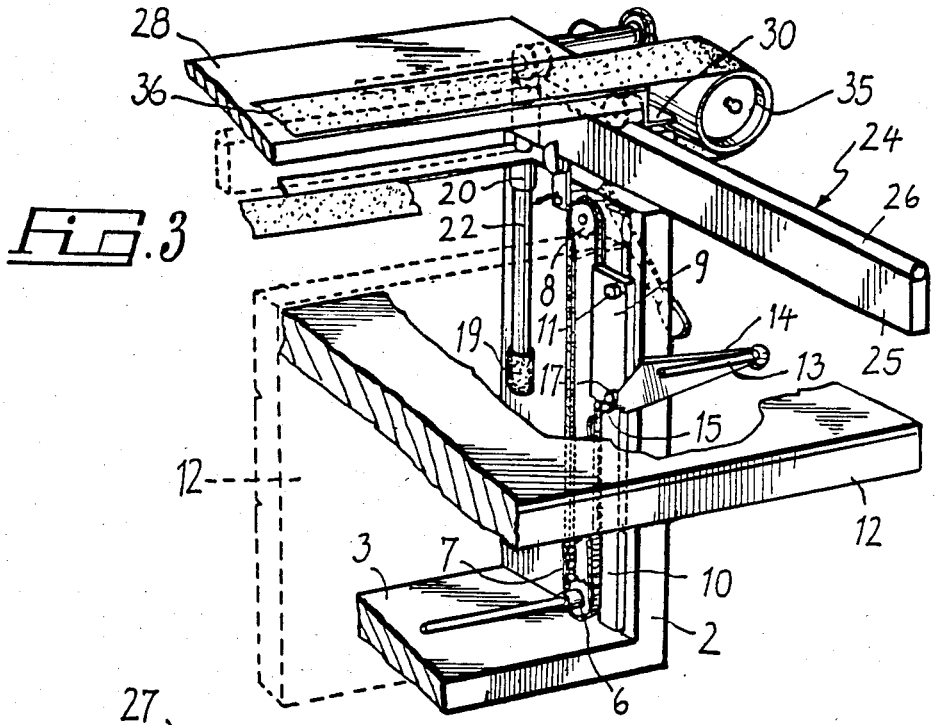
FIGS. 2 and 3 show, in an enlarged scale, the opposite ends of the sander.
Figure 2:
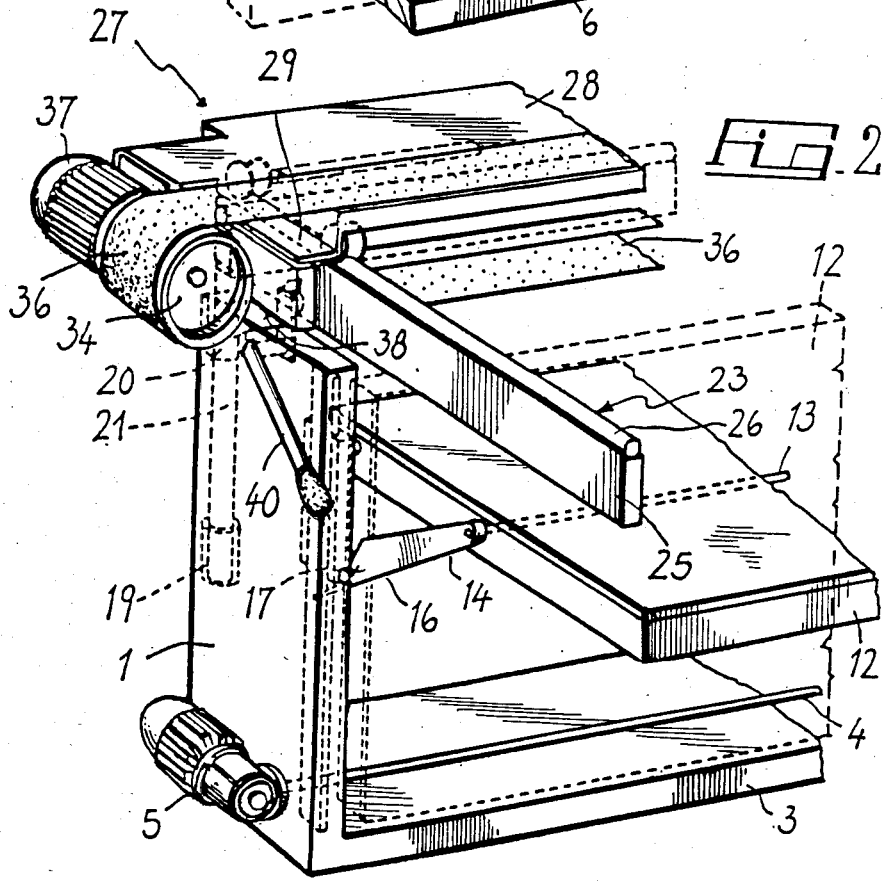

Pivotally connected to the shoes, as by coaxial trunnions 11, is the table or working deck 12 which may be rotated from the horizontal position shown in full lines to the upright position shown in dash lines in FIGS. 1–3.

Carried rotatably beneath the table is a longitudinal rod 13, the ends whereof extend outwards from the opposite ends of the table and carry two radial arms 14 secured thereto.

The arms 14 are provided at the free ends thereof with fingers 15 which form extensions of the arms 14 and have notches 16 therein which are adapted to be engaged by trunnions 17 projecting from the shoes 9 and lying below the trunnions 11. The rod 13 is provided, at the middle thereof, with a manually operated handle 18 which enables the rod, and hence the arms 14, to be turned when the table 12 is to be shifted between the horizontal and vertical positions. Expediently, the trunnions 17 would include angularly adjustable cams to permit the lay of the working deck 12 to be adjusted.

Fixedly mounted to the sidepieces 1,2, close to the rear edges thereof, are pairs of vertically aligned bushings 19,20 which carry rods 21,22 rotatably journalled therein adapted to axially support guides 23,24.

Each guide 23,24 comprises a bracket 25 having a cylindrical rail 26 attached to the top edge thereof.

The guides 23,24 may be shifted, by rotation in the bushings 19,20, from an operative position wherein they extend parallel to each other, (as shown in FIG. 1) to an inoperative position wherein they are in alignment with each other and parallel to the longitudinal direction of the sander.

Along the guides 23,24, in the operative position thereof, a carriage 27 is movable which comprises a beam 28, the opposite ends whereof carry outwardly bent angle pieces 29,30, positionable on the tops of the sidepieces 1,2, when the carriage 27 is inoperative.

Journalled to the angle pieces 29,30, cantilever-fashion in an inward direction, are pairs of peripherally grooved wheels 31,32 adapted to roll along the rails 26 of the guides 23,24. The wheels 31 of each pair are interconnected by an axle 33 to ensure a proper movement of the carriage, i.e. to cause it to move in a constantly perpendicular attitude to the guides 23, 24.

Carried at the opposite ends of the carriage 27, about parallel and horizontal axes, are training pulleys 34,35 for a sand belt 36. The pulley 34 is driven by a motor 37 supported on the carriage 27.

The pulleys 34,35 have the same diameter, thereby the two sand belt runs will extend parallel to each other. The upper run moves over the beam 28, and the lower run under the bottom edges of the guides 23,24. The distance separating the beam 28 from the lower belt run is selected to allow the guides 23,24 therebetween.

In order to prevent the lower run of the sand belt from interfering, as the carriage 27 is moved along the guides 23,24, with the sidepieces 1,2, forwardly open slots 38,39 are provided in the latter.

Engagement of the wheels 31,32 with the rails 26 is controlled by devices operative to control the raising of the guides 23,24. Each device comprises a lever 40 having a pivot pin 41 journalled in the sidepiece 1,2. Radially attached to the pin 41 is a short arm 42 biased by a spring 43 and carrying, at its free end, a roller 44 and a plate 45 in the shape of a semicircle adjacent the roller.

By acting on the lever 40, the arm 42 may be swung from a tilted position into a substantially vertical position. In the latter position of the arm, the rollers 44 will engage with the bottoms of the brackets 25, thereby raising the latter and bringing the rails 26 to tangentially contact the rollers 31, 32 of the carriage. The upward movement length is calculated to also elevate the angle pieces 29,30 off the tops of the sidepieces 1,2 whereon they rest when the carriage 27 is inoperative. In this position, any rotation of the guides 23,24 is inhibited, in the outward direction by abutment on the sidepieces 1,2, and in the inward direction by the plates 45 acting as stops.

Figure 5:
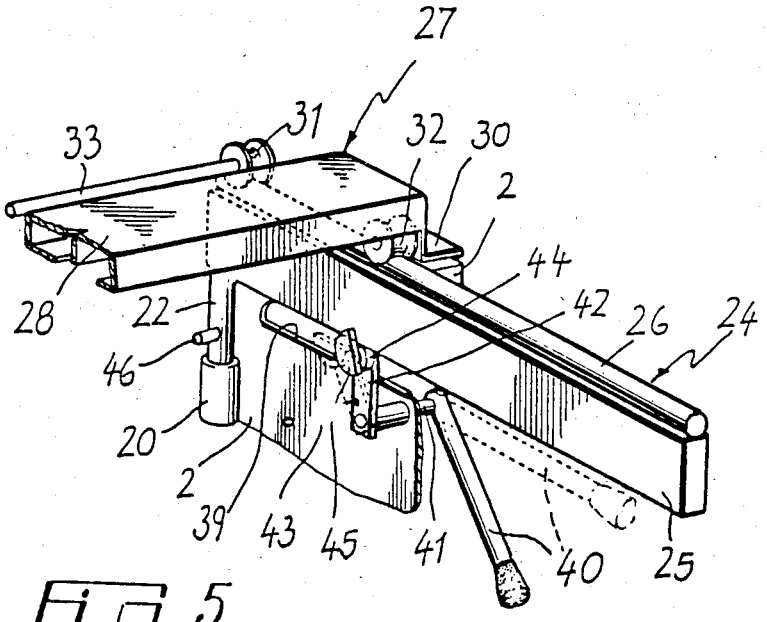
FIG. 5 is a detail view of the guide linkage in the sander of the preceding figures.

On the arms 42 being turned into the tilted position shown in phantom lines in FIG. 5, the carriage 27 is brought, by means of the angle pieces 29,30, to bear on the tops of the sidepieces 1,2, whilst the guides 23,24 are moved further down until the rails 26 are separated from the wheels 31,32 to a sufficient extent to permit the guides to be turned inwards. At the end of the downward movement of the guides 23,24, as determined by detents 46 on the rods 22 abutting the bushings 20, the plates 45 have assumed an orientation which permits the guides to be turned inwardly.

In order to hold the abrasive surface of the lower run of the sand belt 36 in contact with the workpiece, a pressure member generally indicated at 47 mounted slidably on the carriage 27, is arranged to act on the back side of the belt.

Figure 4:
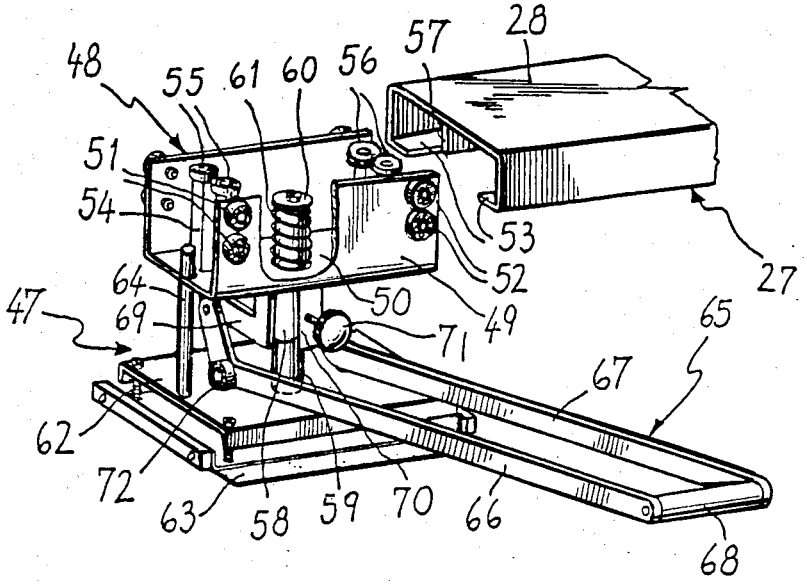
FIG. 4 is a detail view of the pad used to hold the sand belt pressed against the workpiece.

More specifically, and as shown best in FIG. 4, the pressure member includes a carriage 48 in the form of a U-like element having two plane parallel vertical walls 49 interconnected by a portion or bottom 50. Cantilevered to the outside of the walls 49 are pairs of rollers 51,52 mounted idly. Each pair of rollers 51,52 are adapted to engage from above and below opposed wings 53 of the sectional member forming the beam 28.

Within the carriage 48 and between the walls 49, there extend upwards small posts 54 which are placed side-by-side in pairs and carry at the top respective rollers 55,56. In between each pair of rollers 55,56, there is inserted a rib 57 which is located inwards of the beam 28 and extends longitudinally in the centerplane thereof. Thus, the pairs of rollers 51,52 will guide the carriage 48 in the horizontal plane, the pairs of rollers 55,56 guiding it in the vertical plane.

Formed at the middle of the portion 50 of the carrage 48 is a hole opening into an underlying tube 58 made vertically fast with it. The tube 58 accommodates slidably therein a spigot 59 the upper portion whereof extends between the walls 49 of the carriage. Attached to the top of the spigot 59 is a washer 60 acting as a detent for a spring 61 fitted over the spigot 59 and disposed between the washer 60 and bottom 50.

Rigidly fast with the bottom end of the spigot 59 is a rectangular plate 62 which supports a pad 63 elastically (in a manner known per se and, accordingly, not detailedly described herein). To prevent the plate 62 from turning relatively to the carriage 48, a rod 64 is rigidly attached to the plate which extends parallel to the spigot 58 and extends upwards, slidably through a hole formed in the bottom 50 of the carriage 48.

The pad 63 is held pressed against the sand belt by means of a handle 65 having two bent arms 66,67 interconnected at one end by a handgrip 68. The opposite ends of the arms 66,67 are journalled to a projection 69 of a sleeve 70 surrounding the tube 58. The sleeve 70 is locked on the tube 58 by means of a screw extending through the sleeve 70 and having an operating knob 71 at its outward end.

The bends of the arms 66,67 carry two idler rollers 72 which are held in tangential contact with the plate 62 by the weight of the handle 65.

In the operating condition, the sander is as shown in FIG. 1, where the table 12 is held in a horizontal position by the arms 14, while the guides 23,24, being raised by the action of the arms 42 raise, in turn, the carriage 27 off the tops of the sidepieces 1,2 allowing it to be moved along the rails 26. At this stage, one provides for holding the workpiece on the table 12. The holding of the workpiece on the table may be achieved by means of clamps or one or more adjustable stops **12*a* (which may substantially have a double 'T'-like cross-section), which are moveable (and can be locked in position) in grooves 12*b* (having a corresponding inverted 'T'-like cross-section) extending longitudinally and laterally on the table 12, as known per se, and as such, discussed no further herein. By operation of the gear motor 5, the table 12 is brought to a desired elevation whereat the surface to sanded directly underlies the lower run of the sand belt. Then, after energizing the motor 37 and by acting on the handle 65, the carriage 27 is shifted along the guides 23,24 in a transverse direction to the direction of movement of the sand belt. Simultaneously, by lowering the handle 65, the sand belt 36 is brought into contact with the workpiece and the sanding passes are effected by sliding the carriage 48 along the beam 28**.

Of course, the operations may be performed by the operator in a different order from that described, and sanding can be controlled by applying a higher or lower pressure to the pad 63 through the handle 65.

It should be noted that the pad 63 is always held parallel to the working table 12 in the operative position thereof to ensure true sanding at all times.

When the sander is not in use and its overall dimensions are to be reduced, the table 12 is first tilted into a vertical position. To this end, the table is first brought to a preset elevation to permit tilting without interfering with the sand belt 36 or base 3. Then, the table is raised at the front edge to disengage the cam trunnions 17 from the notches 16 of the arms 14. Thereafter, by operating the handle 18, the arms 14 are turned downwards and the table is turned about the trunnions 11 as indicated by the arrow A into a position between the sidepieces 1,2 to eventually take the vertical attitude shown in phantom lines in FIGS. 1-3. It should be noted that during this step the cam trunnions 17 are held peripherally in engagement with the upper edges of the arms 14.

Thus, the knob 71 is exposed which, once loosened, enables the handle 65 to be turned into a position lying longitudinally beneath the beam 28 thereby avoiding that the same may protrude frontally out (see arrow B). At this point, the overall dimensions of the guides 23,24 are reduced. The carriage 27 is pushed toward the rear of the sander where specially provided detents, not shown in the drawings but easily appreciated, lock it at a position where the angle pieces 29,30 are located above the tops of the sidepieces 1,2. Now, by raising the handles 40 into the position indicated in phantom lines in FIG. 5, the guides 23,24 are lowered. During this downward movement (arrow C in FIG. 1), the carriage 28 is first brought to bear onto the tops of the sidepieces 1,2, and immediately afterwards, the rails 26 are separated from the wheels 31,32 of the carriage. The downward movement of the guides 23,24 is halted by the stops 46 abutting the bushings 20. It now becomes possible, by swinging as indicated by the arrow D the guides 23,24, to bring the latter into a position of mutual alignment beneath the beam 28, thereby the transverse dimension of the sander practically becomes that established by the sidepieces 1,2.

A peculiar feature of the sander according to the invention is that the sander may be operated with the table 12 lying on a vertical plane. This enables sanding of the board edges, which would be otherwise impossible with conventional machines or would involve unusual engineering. With the table laid vertically, it is also possible to sand workpieces of a large size since the useful clearance under the sand belt, with the carriage shifted out of the frame, that is at the lower extremity of the guides 23,24, is unaffected by the presence of the underlying table.

The invention may be variously modified and altered without departing from the purview of the inventive concept.

In particular, reduction of the guides 23,24 to within the overall dimensions of the frame may be implemented in various ways.

Figure 6:
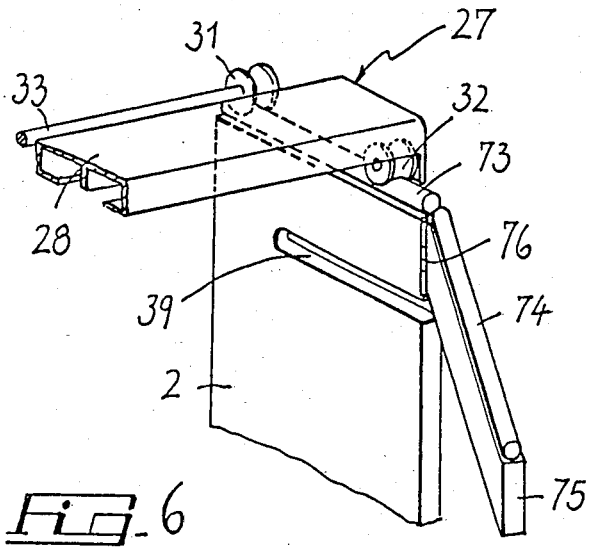
FIGS. 6 and 7 illustrate other embodiments of the beam guide linkage.

FIG. 6 shows an embodiment wherein the rails are attached with their portion 73 directly to the upper edges of the sidepieces 1,2, and for the remainder 74 are attached to brackets 75 journalled at 76 about vertical axes to the front edges of the sidepieces.

In the inoperative condition, the brackets 75 are turned into a horizontal plane from a cantilevered position, wherein the portions 73,74 of the rails are aligned together, to a position wherein the brackets 75 are close to the inward faces of the sidepieces 1,2.

Figure 7:
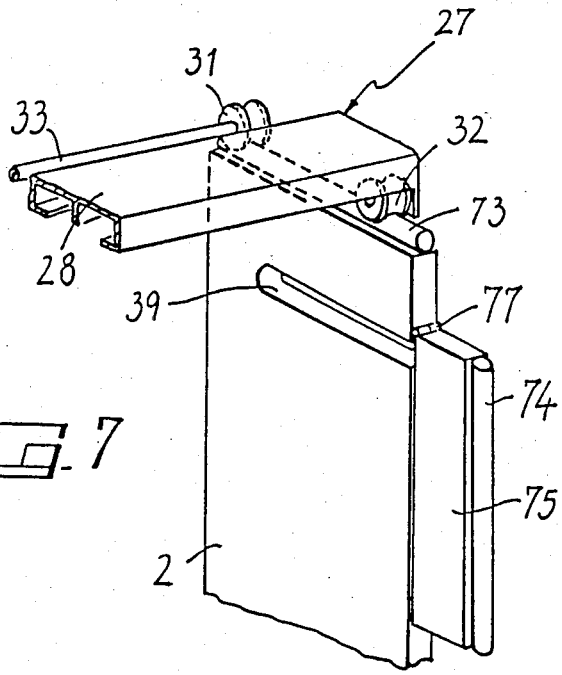

The brackets 75, instead of turning in a horizontal plane, may be journalled to the sidepieces along the horizontal pivot axis 77, as shown in FIG. 7. In this case, the brackets 75, with the sander inoperative, would be brought to bear on the front edges of the sidepieces.

Compared to the embodiment of FIGS. 1-5, the embodiments of FIGS. 6 and 7 are simpler constructionwise because they require no lifting devices for the brackets and carriage, and on account of the bracket articulation also being made simpler. However, the need for breaking the rails results in a junction which may adversely affect the smooth movement of the carriage 27.

In a further embodiment, the guides 23,24 are provided with a telescopic construction, reducable over the edges of the sidepieces 1,2.

I claim:

1. A belt sander comprising:
- a frame including spaced end uprights of relatively small depth front to back;
- a table for a workpiece;
- means attaching said table to said frame for vertical adjustment relative thereto;
- means fastening said table to said attaching means for movement between a horizontal position projecting forward of said uprights and a vertical position substantially between said uprights;
- a carriage extending between and across the upper ends of said uprights;
- an endless sand belt trained over pulleys carried by the opposite ends of said carriage and having a run over and a run under said carriage;
- power means carried by said carriage for driving one of said pulleys and thereby said belt;
- means carried by said carriage for movement therealong parallel to said belt runs and having a pad interposed between said carriage and said belt under run for pressing a section of said under run against a workpiece therebelow;
- guide means for said carriage secured to said uprights adjacent said upper ends thereof and projecting forward thereof for movement of said carriage therealong at right angles to said belt runs, said guide means being foldable to reduce the projecting dimensions thereof and thus reduce the front to rear depth of said sander substantially to that of said uprights.

2. The structure defined in claim 1 wherein the fastening means includes:
- a shoe having the table pivotally connected thereto and adjustable vertically on a guide on each of the uprights;
- means for adjusting said shoes vertically including a chain attached to each shoe and driven by power means; and
- a bracing arm pivotally connected to said table at each end thereof and detachably connected to the corresponding shoe to retain, when so connected, said table in its horizontal position, and, when detached, to allow said table to pivot to its vertical position.

3. The structure defined in claim 1 including:
- an upright rod carried by each upright for vertical axial translation and rotary movement about its axis;
- means limiting downward movement of each rod; and
- wherein the inner ends of the guide means are secured to the upper ends of said rods.

4. The structure defined in claim 3 wherein the rods in their downward position disengage the guides from the carriage and allow the latter to rest on the upper ends of the uprights, and including:
- means for raising said rods and said guides therewith to an upper position where said guides engage said carriage and raise it off of said uprights for movement along said guides.

5. The structure defined in claim 4 wherein the raising means comprises an operating handle having a pivot pin journalled in each upright and carrying a short arm biased by a spring and having at its free end a roller and a small plate adjacent said roller, said roller engaging, on operation of said handle, under the corresponding guide to raise it, and the small plate being adapted to inhibit folding of said guide in its raised position.

6. The structure defined in claim 1 wherein a portion of each guide is rigid with the corresponding upright, and the remaining portion is articulated to said rigid portion for folding about one of an upright and a horizontal axis.

7. The structure defined in claim 1 wherein the means carried by the carriage includes:

a spigot guided vertically on said means against the bias of an elastic means, the pad being carried at the lower end of said spigot; and a handle articulated to said means about a vertical axis and oscillable vertically about a horizontal axis to urge said pad against the under run of the belt, said handle being pivotal about said vertical axis from an operable forward projecting position to a lateral stowed position under said carriage.

* * * * *